United States Patent [19]

Jones

[11] Patent Number: 4,579,348

[45] Date of Patent: Apr. 1, 1986

[54] PHANTOM ARROW HEAD ASSEMBLY

[76] Inventor: Bobby L. Jones, 432 Adams St., Elyria, Ohio 44035

[21] Appl. No.: 708,986

[22] Filed: Mar. 6, 1985

[51] Int. Cl.[4] ..... F41B 5/02

[52] U.S. Cl. ..... 273/421

[58] Field of Search ..... 273/419–422

[56] References Cited

U.S. PATENT DOCUMENTS

| | | | |
|---|---|---|---|
| 2,568,417 | 9/1951 | Steinbacher | 273/421 |
| 2,820,634 | 1/1958 | Vance | 273/106.5 B |
| 2,859,970 | 11/1958 | Doonan | 273/421 |
| 3,000,635 | 9/1961 | Nieman | 273/106.5 |
| 3,022,077 | 2/1962 | Doonan | 273/106.5 |
| 3,036,396 | 5/1962 | Swails | 273/419 X |
| 3,138,382 | 6/1964 | McKenzie | 273/106.5 |
| 3,578,328 | 5/1971 | Rickey | 273/421 |
| 3,738,657 | 6/1973 | Cox | 273/420 |
| 4,099,720 | 7/1978 | Zeren | 273/106.5 B |
| 4,166,618 | 4/1980 | Bergman et al. | 273/106.5 R |

FOREIGN PATENT DOCUMENTS

| | | | |
|---|---|---|---|
| 2458998 | 2/1981 | France | 273/419 |

*Primary Examiner*—Paul E. Shapiro

[57] ABSTRACT

An archery hunting head of a tubular design having a piercing tip and plunger assembly on its frontal end. And completely enclosed rotating blades a clutch assembly mounted internally, and a rearward extention for mounting the head to an arrow by a hot gluing method.

3 Claims, 23 Drawing Figures

PHANTOM ARROW HEAD ASSEMBLY

This invention relates to an arrow head and, more particularly to a hunting broadhead for a long bow, compound bow, crossbow, or other bows, or other means designed for casting hunting arrows, spears, bolts and other vehicles capable of carrying hunting heads.

Heretofore it has been known that to cast a broad head for hunting purposes, the head and arrow must be cast with super accuracy.

Until now this has been a problem with conventional bows and more particularly crossbows in that the broad head has a blade balance problem and, a wind factor problem to contend with. Still other problems consist of arrow barbing which is illegal and not permitted in most of the hunting states.

Still other problems are shooting a field tip and hunting head and striking a point of impact at any given yardage. This invention eliminates all of the above unpleasant features as you will readily detect in the enclosed drawings.

In accordance with the present invention, an arrowhead body is provided which encloses the twin blades completely and which contains a friction clutch for applying pressure on the cutting blades thru the opening axis of these blades. A blade to clutch axle pin for holding the cutting blades in the body and a penetrating head with a rearward protruding plunger to activate the cutting blades from their normally closed position, to a partially open position. In addition a plunger guide to hold the penetrating head and plunger into the arrow, also serves as a stop for the rearward position of the penetrating point and a forward position stop of the cutting blade plunger.

The cutting blades are locked into a closed position by a dimple or indentation on each blade overlaying one another.

The cutting blades remain completely in the locked position until the arrow head comes into contact with the intended target. Upon striking the target, the penetrating point and the cutting blade plunger are forced rearwardly with sufficient force as to partially open the cutting blades.

When the blades have opened a distance of approximately 12 degrees, the design and the contour of the blades are such that the blades will progressively open as the arrow head enters the target. As the arrow progresses thru the target the cutting blades will have rotated to a rearwardly position of approximately 45 degrees rearward to the arrow shaft thus cutting a full 4" cutting width at the full 90 degree angle from the arrow head body.

The blades are free and fully retractable and therefore do not constitute a barbed arrow head. This arrow head is so accurate that it certainly could be used by the American Special Military Forces in the Crossbow Weaponry Arsenal. These and other features will become more readily apparent upon reference to the following detailed description of the invention and by reference to the drawings herein.

DETAILED DESCRIPTION OF THE INVENTION

Figure 20:
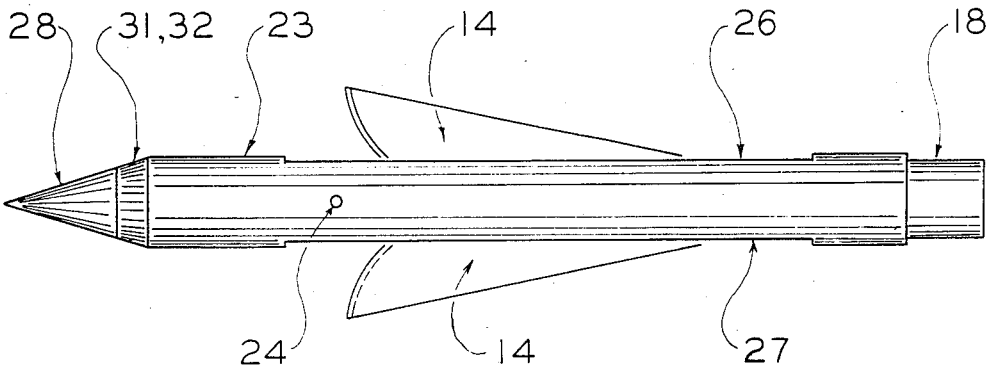
FIG. 20 is an elevation view of the arrow head assembly with the cutting blades in a partially open position.
Figure 21:
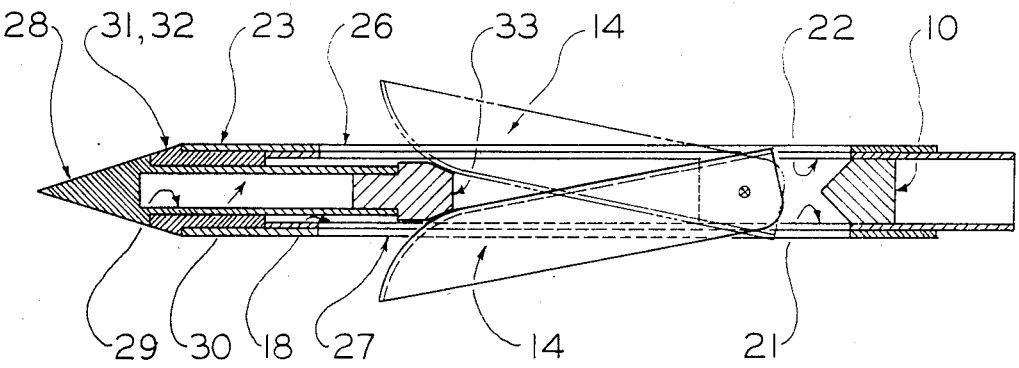
FIG. 21 is a sectional view of the arrow head assembly with the cutting blades in a partially open position.
Figure 22:
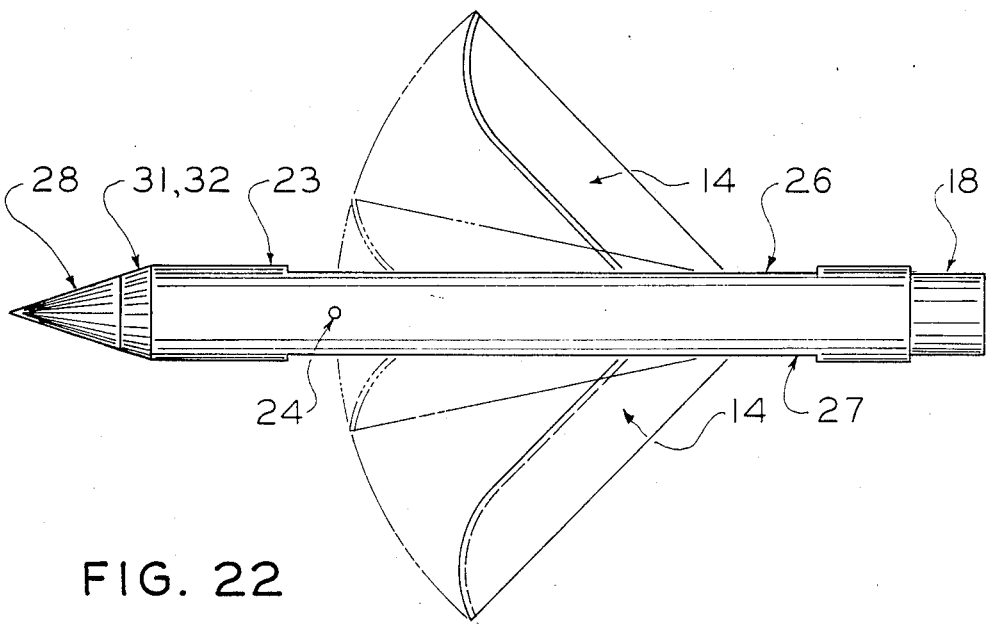
FIG. 22 is an elevation view of the arrow head assembly with the cutting blades in a more fully opened position.
Figure 23:
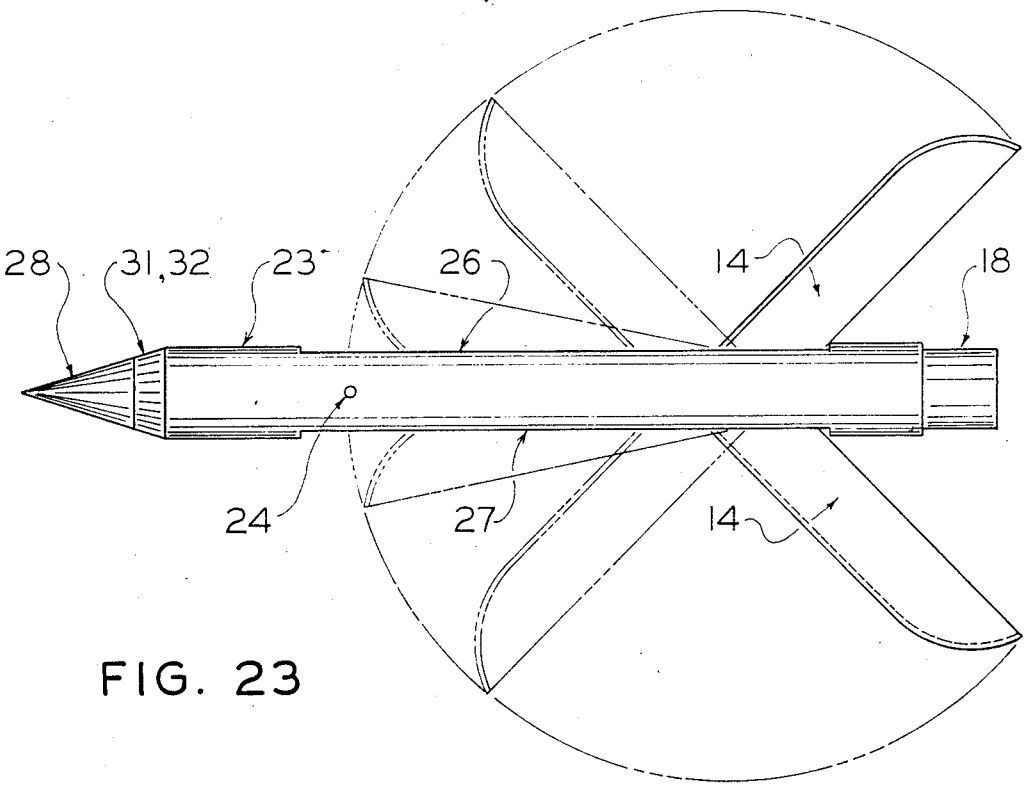
FIG. 23 is an elevation view of the arrow head assembly with the cutting blades in a completely open position.

Referring now to the drawing FIGS. 20 and 21 there is illustrated an archery broad head assembly located generally at 23. The broadhead assembly means 23 consists of a cutting blade holding clutch 10, a pair of cutting blades 14, an inner cylindrical body 18, an outer cylindrical body 23, a conical shaped piercing point 28, a plunger guide 31, a blade opening plunger 33 and a blade axle pin 35.

In order to effect assembly of this invention we will refer to FIG. 21 of the drawings. A clutch body 10 is inserted at the rearward portion of 18 so as to align pin insert holes 11 and 12 of FIG. 19 with pin insert holes of 19 and 20 of internal cylindrical body 18 which will in effect align blade receiving slot 13 with the blade receiving slots 21 and 22 of the internal body 18, and blade receiving slots 26 and 27 of the outer cylindrical body 23.

Insert the rearward portion of the inner body 18 into the frontal portion of outer body 23 until axle pin insert holes 24 and 20 come to complete alignment.

Next insert cutting blades 14 into blade receiving slots 26 and 27 with beveled edge 16 of cutting blade 14 positioned outwardly of each other.

Next align axle pin holes 11 and 12 of blade clutch 10 with axle pin holes 17 of cutting blade 14 and axle pin holes 19 and 20 of inner cylindrical body 18 and axle pin holes 24 and 25 of outer cylindrical body 23.

Next insert axle pin 35 thru receiving holes 24, 25, 19, 20, 17, 11 and 12 making sure axle pin clears the inner wall of the outer arrow head body 23.

Figure 18:
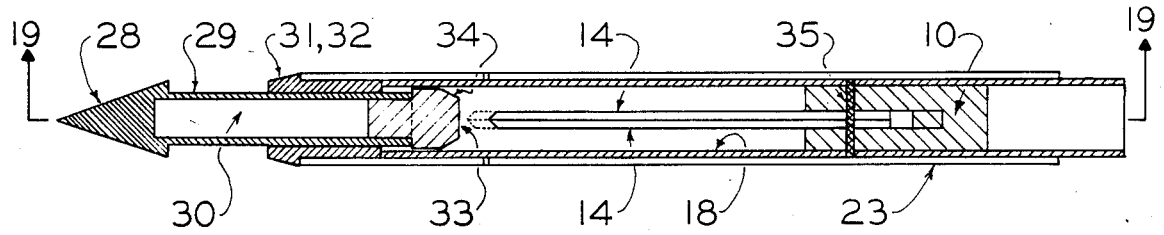
FIG. 18 is a sectional view of the arrow head assembly taken at line 18—18 of FIG. 17.

Next press the inner cylindrical body 18 into outer cylindrical body 23 so as to effect a seemingly one piece arrow head body as seen in FIG. 18.

Figure 1:
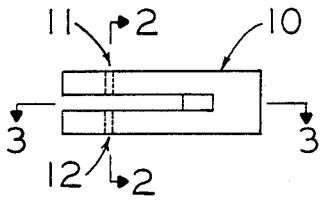
FIG. 1 is a side elevation view of the blade holding clutch.
Figure 2:
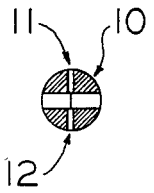
FIG. 2 is a sectional view of the blade holding clutch taken along line 2—2 of FIG. 1.
Figure 3:
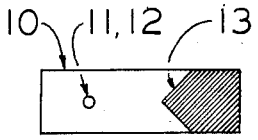
FIG. 3 is a sectional view of the blade holding clutch taken along line 3—3 of FIG. 1.
Figure 4:
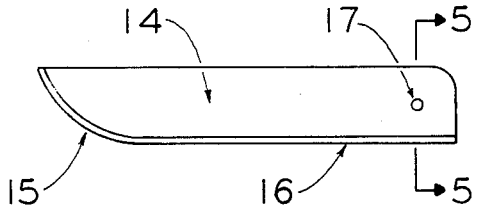
FIG. 4 is a side elevation view of a cutting blade.
Figure 5:
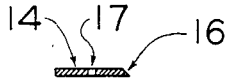
FIG. 5 is a sectional view of the cutting blade taken along line 5—5 of FIG. 4.
Figure 6:
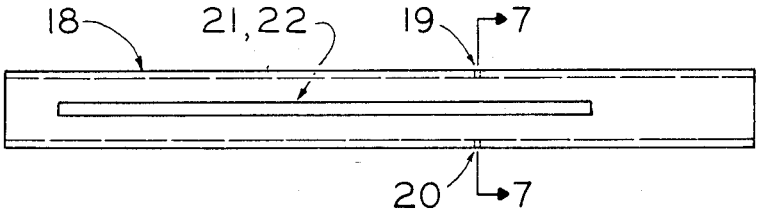
FIG. 6 is a side elevation view of the inner arrow head housing.
Figure 7:
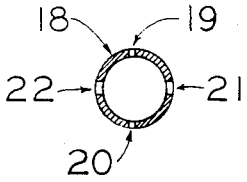
FIG. 7 is a sectional view of the inner arrow head housing taken along line 7—7 of FIG. 6.
Figure 8:
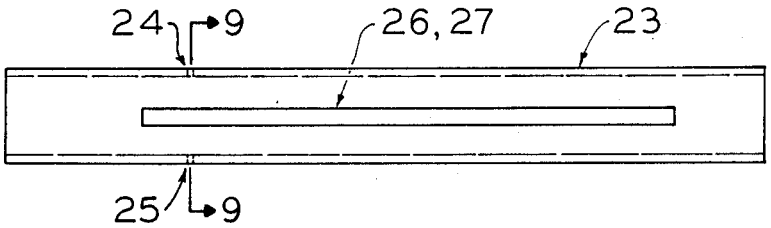
FIG. 8 is a side plan view of the outer arrow head housing.
Figure 9:
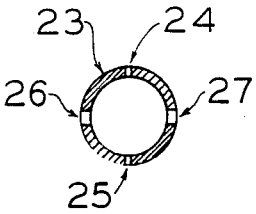
FIG. 9 is a sectional view of the outer arrow head housing taken along line 9—9 of FIG. 8.
Figure 10:
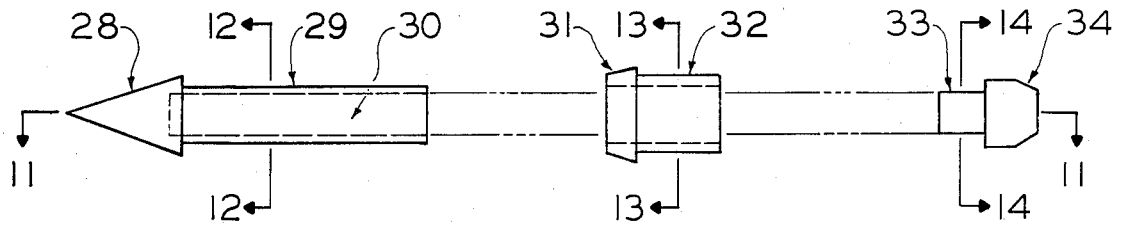
FIG. 10 is an exploded view of the arrow head, guide bushing and blade plunger.
Figure 11:
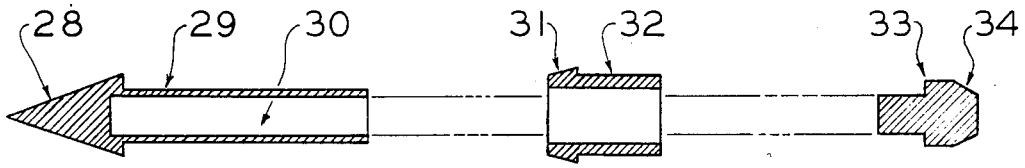
FIG. 11 is a sectional view of the arrow head, guide bushing and blade plunger taken along line 11—11 of FIG. 10.
Figure 12:
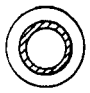
FIG. 12 is a sectional view of the arrow head taken along line 12—12 of FIG. 10.
Figure 13:
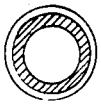
FIG. 13 is a sectional view of the guide bushing taken along line 13—13 of FIG. 10.
Figure 14:
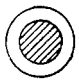
FIG. 14 is a sectional view of the blade plunger taken along line 14—14 of FIG. 10.
Figure 15:
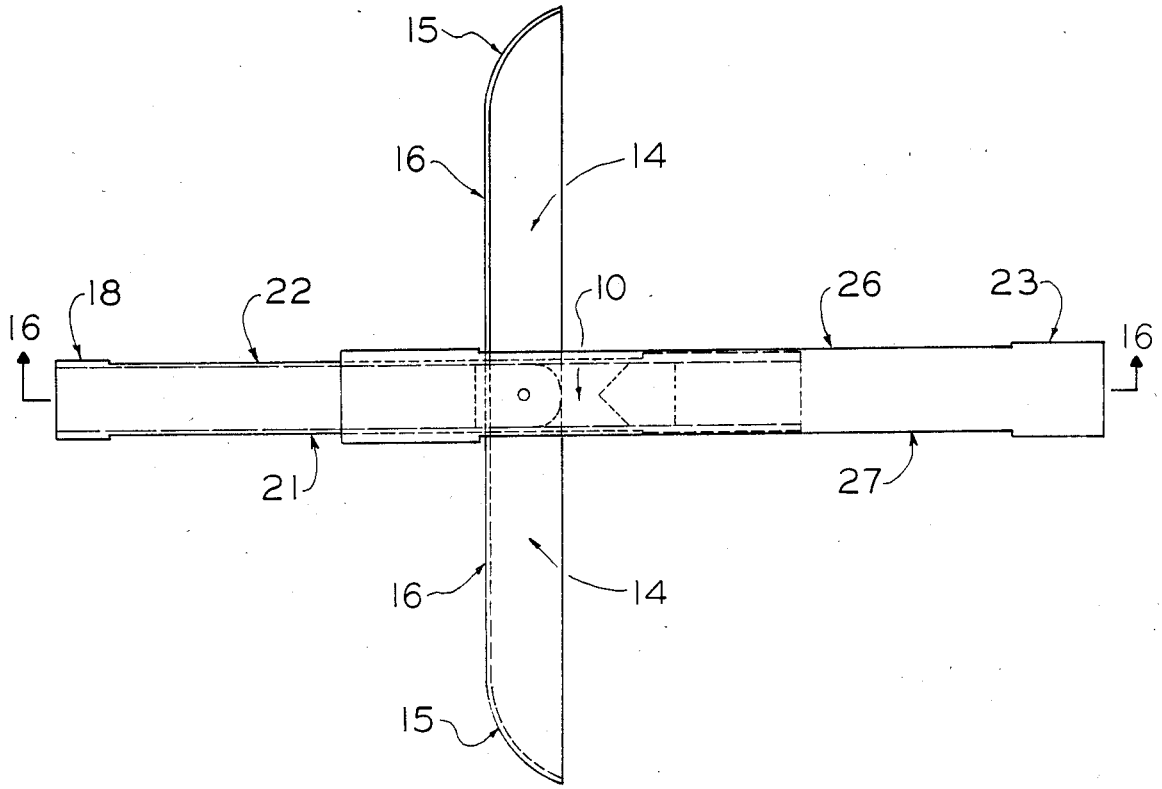
FIG. 15 is a partial plan view of the arrow head assembly.
Figure 16:
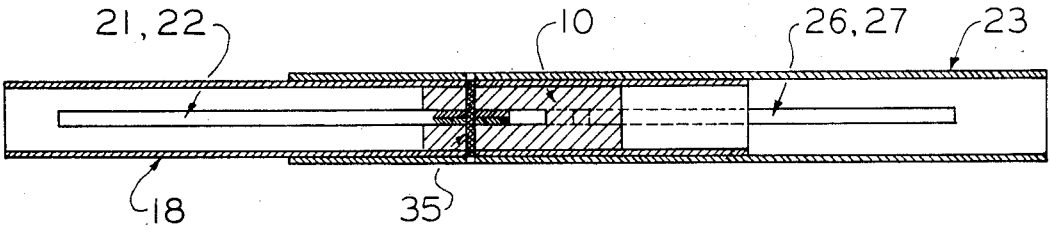
FIG. 16 is a sectional view of the arrow head assembly, with the cutting blades in an open position taken along line 16—16 of FIG. 15.
Figure 17:
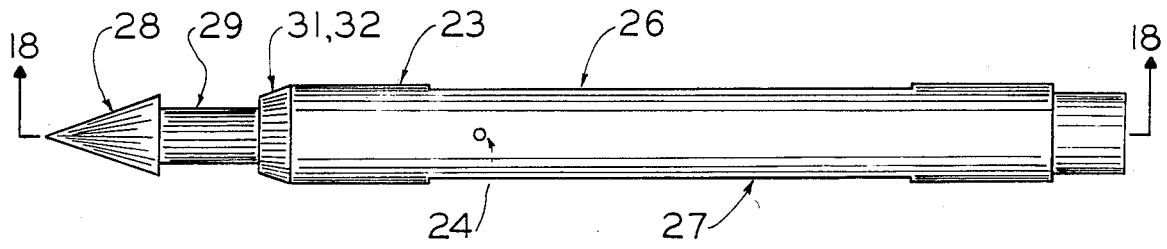
FIG. 17 is an elevation view of the arrow head assembly.

Now referring to FIG. 11 of the drawings in order to effect assembly of this unit and install said unit into arrowhead, position guide tube 29 of conical piercing point 28 thru center of guide bushing 32 until shoulder 31 of guide bushing 32 seats properly with a rearward stop shoulder on piercing point 28. Position blade plunger 33 into the rearward portion of guide tube 30. Crimp guide tube 30 with tool to insure a secure lock on to plunger 33.

With this unit in complete assembly insert plunger guide 32 into the frontal portion of arrow head body 23 and press unit until the rear stop shoulder 31 of 32 plunger guide body comes into contact with the frontal portion of arrow head body 28. This completes the assembly of the arrow head which consists of A. An arrow head cylindrical body.

B. A piercing tip and plunger assembly.

C. A blade and clutch assembly.

Figure 19:
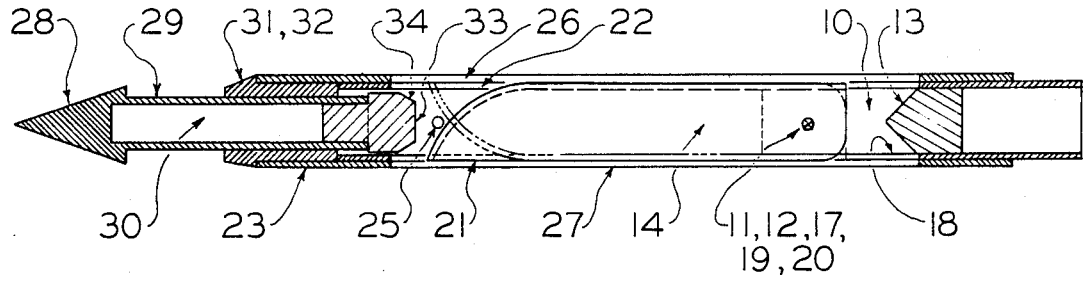
FIG. 19 is a sectional view of the arrow head assembly taken at line 19—19 of FIG. 18.

To demonstrate the full operation of this broadhead we refer to FIG. 19 of the drawings, section B—B which is a cross sectional top view of the arrowhead in a ready to shoot position.

The arrow is released by a bow or other means of propelling a hunting head along a path to the intended target. Upon initial contact with the target the conical plunger tip 28 and blade opening plunger 33 stops momentarily until the full force of the arrow mass progresses forwardly thus forcing the cutting blade plunger 33 to make contact with cutting blade 14 at a point generally at 15 causing a wedging action between the cutting blades 14 and forcing the cutting blades 14 to open to an apporximate angle of 12 degrees.

At this point of contact the rearward shoulder of the conical point 28 has made contact with the frontal shoulder of the plunger guide 31, causing the conical head 28 to start the deep penetration of the target.

Referring now to FIG. 21 of the drawings, a cross sectional view thru horizontal axis, we see the conical point 28 in a closed or blade partially open position. As the conical point 28 and the arrow head body 23 enter the target approximately one inch.

The cutting blade 14 comes into contact with the target at the radius point 15 of the cutting blade 14 causing the blade 14 to begin penetration and a progressive blade opening thru its horizontal axis. As the cutting blade 14 exits from the arrow head body 23 at blade slots 26 and 27 thru its horizontal axis the blades are held at a pre-determined opening time, by the arrow head blade holding clutch 10 by pressure exerted on the cutting blades 14 which are held into position by the axle pin 35 in the progressive opening of the cutting blades 14, they will continue thru a horizontal axis to a high point of ninety degrees. At this point the cutting blades will constitute a cut of approximately 4 inches wide and continue to a blade stop at 13 of the cutting blade clutch body 10 stopping the cutting blades at a forty five degree angle rearwardly of the arrow head body 23. After the arrow head has been removed from the target the cutting blades 14 are rotated forwardly to an enclosed position into the arrow head body 23 which in turn forces the plunger and piercing tip forward to set the arrow head in position for the next firing shot.

While a presently preferred embodiment of the invention has been illustrated and described it will be recognized that the invention may be otherwise variously embodied and practiced within the scope of the claims which follow.

I claim:

1. A combined hunting arrow head assembly which comprises:

(a) an outer cylindrical arrow head body having a pair of diametrically opposed slots and a pair of diametrically opposed holes perpendicular thereto and located to the rear thereof;

(b) an inner cylindrical arrow head body slidably received within said outer body and having a pair of diametrically opposed slots aligned and in register with the slots of said outer body; said inner body being longer than said outer body whereby a portion thereof extends outwardly from the rear end of said outer body for the reception thereon of the forward end of an arrow shaft;

(c) a cutting blade clutch having a pair of legs defining therebetween a blade receiving notch, mounted in the rear end of said inner body and a pair of holes in said legs perpendicular to said notch and aligned with the holes in said inner body;

(d) at least one blade having a rear end received in said slot between said legs and having a hole therethrough in alignment with said holes in said legs and inner body, said clutch normally holding said at least one blade extending forwardly within said inner body in alignment with said slots;

(e) an axle pin extending through the aligned holes in said inner body, clutch legs and blade;

(f) a conical penetrating point having an elongate rearwardly extending tubular body and a forward shoulder extending outwardly from said tubular body;

(g) a blade opening plunger secured to the rear end of said tubular body;

(h) a guide bushing surrounding and slidably receiving said tubular body and fastened to the forward end of said outer body for holding and aligning said penetrating point and plunger to said arrow head; said point being normally positioned spaced forwardly from said bushing;

(i) the rearward end of said plunger and the forward end of said at least one blade having cooperating means for pivoting said blade about said axle pin whereby when said arrow head strikes a target said tubular body slides rearwardly through said bushing forcing the plunger against the blade to pivot the blade outwardly of said outer body through said slots.

2. The structure of claim 1 wherein said blade opening plunger including a concave shaped head.

3. The structure of claim 1 where said clutch includes means for applying biasing pressure to said cutting blades.

* * * * *